US006380965B1

(12) United States Patent
Sims et al.

(10) Patent No.: US 6,380,965 B1
(45) Date of Patent: Apr. 30, 2002

(54) TAPE PRINTING APPARATUS

(75) Inventors: Charles Roberts Sims, Hertfordshire; Robert Charles Lewis Day, Fulbourn; Mathew Richard Palmer, Cottenham; Andrew Richard Buchanan Halket, Cambridge, all of (GB)

(73) Assignee: Esselte N.V., Sint-Niklaag (BE)

( * ) Notice: Subject to any disclaimer, the term of this patent is extended or adjusted under 35 U.S.C. 154(b) by 0 days.

(21) Appl. No.: 09/284,236

(22) PCT Filed: Sep. 16, 1997

(86) PCT No.: PCT/EP97/05062

§ 371 Date: Apr. 14, 1999

§ 102(e) Date: Apr. 14, 1999

(87) PCT Pub. No.: WO98/16391

PCT Pub. Date: Apr. 23, 1998

(30) Foreign Application Priority Data

Oct. 14, 1994 (GB) ..... 9621378

(51) Int. Cl.[7] ..... B47J 2/325
(52) U.S. Cl. ..... 347/218
(58) Field of Search ..... 400/582, 583, 400/583.2, 583.3; 347/218, 188; B41J 11/46

(56) References Cited

U.S. PATENT DOCUMENTS

| | | | | |
|---|---|---|---|---|
| 3,708,748 A | * | 1/1973 | Nassimbene | 375/239 |
| 4,389,009 A | | 6/1983 | Yamashita | |
| 4,492,482 A | * | 1/1985 | Eguchi et al. | 347/182 |
| 4,808,832 A | * | 2/1989 | Doggett | 250/548 |
| 5,608,443 A | * | 3/1997 | Palmer et al. | 347/218 |
| 5,853,255 A | * | 12/1998 | Soshi et al. | 400/237 |
| 5,997,194 A | * | 12/1999 | Nunokawa et al. | 347/188 |

FOREIGN PATENT DOCUMENTS

| | | |
|---|---|---|
| EP | 0592198 A2 | 4/1994 |
| EP | 0641663 A2 | 3/1995 |

OTHER PUBLICATIONS

Disclose Anonomously, 'Ribbon Cartridge Detection', Research Disclosure, No. 286, p. 77, NY USA, Feb. 1988.*
Patent Abstracts of Japan, vol. 096, No. 011, Nov. 29, 1996 & JP 08 183205 A (Alps Electric Co. Ltd.), Jul. 16, 1996.
Patent Abstracts of Japan, vol. 017, No. 682 (M–1528), Dec. 14, 1993 & JP 05 229542 A (Fuji Facom Corp.), Sep. 7, 1993.
Patent Abstracts of Japan, vol. 005, No. 193 (M–101), Dec. 9, 1981 & JP 56 113642 A (Iijima Susumu), Sep. 7, 1981.
Patent Abstracts of Japan, vol. 096, No. 008, Aug. 30, 1996 & JP 08 090876 A (Casio Comput Co. Ltd.) Apr. 9, 1996.

* cited by examiner

*Primary Examiner*—N. Le
*Assistant Examiner*—K. Feggins
(74) *Attorney, Agent, or Firm*—Jones, Tullar & Cooper, P.C.

(57) ABSTRACT

The invention relates to a tape printing apparatus for printing an image on an image receiving tape. In order to detect characteristics of the tape thus avoiding representation means on a tape cassette, it is proposed to have detecting means for detecting-markings provided on the image receiving tape, which provide information on a characteristic of the tape; and the tape printing apparatus is controlled in accordance with the detected characteristics. Alternatively, it is proposed to have monitoring means for monitoring the speed of the image receiving tape, which detect marking on the image receiving tape whereby the printing means is controlled in dependence on the detected speed. Consequently, the exact tape speed is considered for printing purposes, even when slippage between driving means and tape occurs.

25 Claims, 6 Drawing Sheets

TAPE PRINTING APPARATUS

FIELD OF THE INVENTION

The present invention relates to a tape printing apparatus and, in particular, but not exclusively, is concerned with a drive system for a tape printing apparatus. The present invention also relates to a supply of image receiving tape for a tape printing apparatus.

BACKGROUND OF THE INVENTION

Known tape printing apparatus of the type with which the present invention is generally concerned are disclosed in European Patents, EP-A-322918 and EP-A-322919 (Brother Kogyo Kabushiki Kaisha) and European Patent EP-A-267890 (Varitronic). The tape printing apparatus have a cassette receiving bay for receiving a cassette or tape holding case. In EP-A-267890, the tape holding case houses an ink ribbon and a substrate tape, the latter comprising an upper image receiving layer secured to a backing layer by an adhesive. In EP-A-322918 and EP-A-322919, the tape holding case houses an ink ribbon, a transparent image receiving tape and a double-sided adhesive tape which is secured at one of its adhesive coated sides to the image receiving tape after printing and which has a backing layer peelable from its other adhesive coated side. With both these apparatus, the image transfer medium (ink ribbon) and the image receiving tape (substrate) are in the same cassette.

In all of these apparatus, the image receiving tape passes in an overlap matter with the ink ribbon to a print zone consisting of a fixed print head and a platen against which the print head can be pressed to cause an image to transfer from the ink ribbon to the image receiving tape. There are many ways of doing this, including dry lettering or dry film impression, but the most usual way at present is by thermal printing where the print head is heated and the heat causes ink from the ink ribbon to be transferred to the image receiving tape. Alternatively, the print head may be in direct contact with a thermally sensitive image receiving tape whereby when the print head is heated, an image is defined directly on the image receiving tape, without the need for an ink ribbon.

The known tape printing apparatus have input means, for example, a keyboard to allow the user to input an image to be printed. A display may be provided to display the input image and/or messages to the user. A cutting arrangement is provided to separate the image receiving tape on which an image has been printed from the supply of image receiving tape to thereby define a label.

European Patents EP-A-575772 (Esselte Meto International Produktions GmbH) discloses a thermal printer arranged to print bar code information or the like on discrete labels. The discrete labels may be supported on a backing sheet. Markings to identify the characteristics of the label may be provided either on the label itself or on the backing sheet. The markings, if provided on the label, are invisible. The markings are read by the thermal printer and may be used to determine whether an image should be printed directly on the label by the thermal printer or whether an ink ribbon is required to print an image on the label.

U.S. Pat. No. 4,531,850 (K.K. Sato) describes a printer which is arranged to print an image on a plurality of discrete labels carried on a backing web. Each label on the backing web has a mark thereon which is used to control the timing of the printing. In other words, the signal resulting from the detection of the marks on each label is used to control when the printer is activated so that the image falls within the label boundaries. Thus, a signal is sent to a control unit connected with a thermal head and the printing operations are conducted in response to the instructions coming from the control unit. The label maybe temporarily halted during printing.

Published International Application WO 96/04142 (Laser Master Corp.) describes a printer having the capability of multiple colour printing. Accordingly, a locating pattern is provided on the image receiving media to ensure that subsequent layers of colour correctly overlie previous layers. The markings on the print media are used to determine where printing should take place.

British Patent GB-A-2228449 (Tokyo Electric Co. Ltd.) discloses an ink ribbon for use in multiple colour printing. The ink ribbon has a plurality of colours sequentially aligned along the tape. Between the regions of different colours, colour recognition marks are provided so t hat the next colour can be identified. A plurality of evenly spaced markings are also provided on the tape from which the ribbon speed is determined. The speed of the ribbon varies as the ribbon spool is driven at a constant speed. The speed of the ink ribbon is used to correct readings obtained from the colour recognition marks so that the correct colour can be determined.

SUMMARY OF THE INVENTION

According to a first aspect of the present invention, there is provided a tape printing apparatus for printing an image on an image receiving tape, the apparatus comprising:

- input means for receiving data defining an image to be printed on the image receiving tape;
- receiving means for receiving a supply of image receiving tape;
- printing means for printing an image on the image receiving tape;
- detecting means for detecting markings provided on the image receiving tape, the markings being arranged to provide information on a characteristic of the image receiving tape; and
- control means for controlling the tape printing apparatus in accordance with the detected image receiving tape characteristic.

Thus, it is possible to use the signals provided by the detecting means for controlling the printing apparatus in accordance with the detected image receiving tape characteristics. The image receiving tape may be provided with markings indicating, e.g. the tape width and/or printing energy required for obtaining optimal printing results. The tape printer can thus size the image to be printed according to the detected tape width and/or select the printhead energy appropriately. Further, the markings can represent tape background color, tape printing color or tape length. The latter characteristics will be primarily used for display purposes, informing the user about the parameters of the tape he is using. This aspect of the invention allows to dispense with representation means in a cassette (as disclosed, e.g. in EP-A-497352 or EP-A-534794) or in a tape replacement unit, as disclosed, e.g. in EP-A-635375, since only the image receiving tape as such is necessary for detecting the markings and hence controlling the printer. The invention is consequently applicable for image receiving tape provided in cassettes, and in replacement spools without any cassette, as well.

According to a second aspect of the present invention, there is provided a tape printing apparatus for printing an image on an image receiving tape, the apparatus comprising:

input means for receiving data defining an image to be printed on the image receiving tape;

receiving means for receiving a supply of the image receiving tape;

printing means for printing an image on the image receiving tape in accordance with the input data, the printing means being controlled by control means;

a drive system operable to drive the image receiving tape past the printing means; and monitoring means for monitoring the speed of the image receiving tape, the monitoring means being arranged to detect markings provided on the image receiving tape and to provide a signal indicative of the speed at which the image receiving tape moves past the printing means, the monitoring means being connected to the control means for the printing means whereby the printing means is controlled in dependence on the speed of the tape.

By controlling the print head in dependence on the speed of the image receiving tape, it can be ensured that variations in the speed of the drive system or slippage between the drive system and the image receiving tape do not have an adverse effect on the printing. As the printing is controlled in dependence on the measured speed of the tape, variations in the speed of the tape are compensated for by the printing means. Furthermore, a direct correlation between the speed of the image receiving tape and the printing of the image thereon can be achieved.

Preferably, the drive system comprises a motor. The drive system may continuously drive the image receiving tape past the printing means. Alternatively, the image receiving tape may be driven stepwise past the printing means.

The motor may be a dc motor. However, any other suitable type of motor can also be used in embodiments of the present invention.

The input means may be in the form of a keyboard or the like or alternatively may be an input to receive a data stream from a computer or the like.

The markings may be detectable with electromagnetic radiation and the monitoring means preferably comprises a source of electromagnetic radiation and a detector to detect electromagnetic radiation from the source, after the electromagnetic radiation has interacted with the markings on the image receiving tape. The electromagnetic radiation can be any suitable type of radiation such as visible light, ultra violet light or infra-red radiation. The detector can be arranged to detect radiation transmitted through the image receiving tape or reflected therefrom.

The electromagnetic radiation source may comprise a light emitting diode and the detector may comprise a photo transistor. Thus, a cheap, yet effective, monitoring means can be achieved.

Preferably, a grating member is arranged between the detector and the image receiving tape, the grating member having at least one opening, or each opening of the grating may substantially correspond in size and shape to a single marking. It has been found that such a grating member improves the signal provided by the detector. Without the presence of the grating member, the signal provided by the monitoring means may be unsatisfactory or require increased manipulation. The grating member may enhance the differentiation between the markings and the surrounding regions so that a clearer signal is provided by the monitoring means. For example, where the markings are in the form of dark lines on a light background (or vice versa) the contrast between the light and dark regions is emphasised by the use of a grating member. In one preferred embodiment of the present invention, a plurality of openings are provided in the grating member. The spacing between adjacent openings preferably substantially corresponds to the spacing between adjacent markings on the image receiving tape. It is preferably that the width of each marking, the width of the space between each adjacent pair of lines and the width of each opening of the grating are the same.

In an alternative embodiment of the present invention, the monitoring means is operable to detect magnetic markings on the image receiving tape. The magnetic markings may be defined on the image receiving tape with magnetic ink, and the monitoring means may be operable to detect the markings defined by the magnetic ink. Alternatively, the magnetic markings may comprise a plurality of lines formed by recording flux reversals onto a magnetic strip on the image receiving tape, the monitoring means being arranged to detect the lines defined on the magnetic strip.

In the above described embodiments, the markings are preferably in the form of evenly spaced parallel lines extending perpendicular to the length of the image receiving tape. However, the markings may take any other suitable form. For example, the markings may be in the form of evenly spaced parallel lines extending at an angle to the length of the image receiving tape.

In one embodiment, at least one characteristic of the markings at or near an end of the image receiving tape is changed, the monitoring means being arranged to provide a signal indicative of the change in the characteristic of the markings to the control means so that an end of image receiving tape condition is determined. The characteristic of the markings which is changed may be one or more of the following characteristics: pitch of markings; width of each marking; color; and reflectivity of markings. In an alternative embodiment, an end of tape condition can be determined by the monitoring means if there is a lack of markings near or at the end of the image receiving tape.

In an alternative arrangement, the end of the image receiving tape is provided with means for resisting the separation from a supply reel for the image receiving tape, the monitoring means being arranged to provide a signal indicative of the reduction in speed of the image receiving tape caused by the resisting means at the end of the image receiving tape so that an end of tape condition is determined.

Thus, the markings provided on the image receiving tape can also be used in order to determine an end of tape condition as well as to control the printing. In the first described arrangement, the lack of or change in markings provides an indication of an end of tape condition, whereas in the second described arrangement, the reduction in detected speed of the image receiving tape provides an indication of the end of tape condition.

The markings on the image receiving tape are preferably arranged to also provide information as to the characteristics of the image receiving tape, the monitoring means being arranged to detect different markings on different types of image receiving tape and to provide a signal indicative of the different markings so that the characteristics of the image receiving tape are identified. These characteristics can include one or more of the following:

tape size;

tape color; and nature of the image receiving tape such as whether or not an ink ribbon is required in order to print an image on the image receiving tape or if an image can be printed directly onto the image receiving tape without the need for an ink ribbon. The operation of the tape printing apparatus can be altered in dependence upon the detected characteristics of the image receiving tape. The pitch of the markings, the width of the markings, the color of the markings and/or the reflectivity of the markings on the image receiving tape may be varied in dependence on the characteristics of the tape, the monitoring means being arranged to provide a signal indicative of the detected markings. For example, when the speed of the image receiving tape is known (either detected eg. by an encoder on the shaft of the motor driving the tape, or determined by driving the motor with the appropriate parameters, eg. a stepper motor driven with a certain frequency of driving pulses), it is easily to judge from the frequency of detected pulses the pitch of the markings.

The tape printing apparatus is thus able to determine the nature of the inserted type of tape and control the operation of the apparatus accordingly. The apparatus may be arranged to store the information on the characteristics of the tape and only to carry out further checks when it is determined that the supply of image receiving tape may have been changed. For example, checks may only be carried out when it is detected that a lid to the tape receiving means has been opened or a supply of image receiving tape has been removed from the receiving means and replaced.

The drive system may be arranged to drive the image receiving tape backwards after a first image has been printed thereon, and when the image receiving tape is driven forwards again by the drive system a second image may be printed on the image receiving tape overlying the first image, the markings on the image receiving tape being used to position the image receiving tape so that the first and second images overlie one another. This feature is particularly advantageous for those embodiments where multi-color images are required so that images of more than one color overlie one another. In particular, full color printing can be achieved using this technique by using three images, one on top of each other, in cyan, magenta and yellow. Additionally, a further image in black may also overlie the first three images. Of course two tone printing can also be achieved with this technique. The number of images which overlie one another and the number of different colors can be selected as required by the user. Additionally, any color can be selected for the images which overlie one another.

Counting means may be provided for counting the number of markings which pass a given location when the tape is driven past the printing means in the forward direction and for counting the number of markings which pass the given location when the image receiving tape is driven backwards, the counting means being arranged to stop the driving of the image receiving tape in the backwards direction by the drive system when the number of markings which have passed the counting means substantially equals the number of markings counted when the image receiving tape is driven past the printing means in the forwards direction. In this way, an exact overlying of different images may be achieved. The counting means may comprise the monitoring means and the control means. The control means may A count the number of signals provided by the monitoring means. The control means may thus also control the drive system.

The printing means preferably comprises a thermal print head having a group of printing elements to which pixel data defining the image to be printed is passed sequentially on a group-by- group basis by the control means, the groups being sequentially printed adjacent one another in the direction of movement of the image receiving tape. Preferably, the sequential printing of the image on the image receiving tape is controlled by the control means in dependence on the speed of the image receiving tape. In this way, a correspondence between the speed of the image receiving tape and the control of the print head may be achieved.

Speed control means may be provided to control the speed of rotation of the motor to be at an approximately constant level. The speed control means may be coupled to the monitoring means, whereby the speed of the motor is controlled in dependence on the detected speed of the image receiving tape.

Preferably, the speed control means controls the speed of rotation of the motor to maintain the approximately constant level by applying a maximum drive to the motor if the speed of the image receiving tape detected by the monitoring means falls below a first predetermined value, no drive if the speed of the image receiving tape exceeds a second predetermined value and a linear drive versus speed characteristic if the speed of the image receiving tape is between the first and second predetermined values. With this relatively simple algorithm, it is possible to effectively control the speed of the motor within the bounds required by embodiments of the present invention. It should be appreciated that the speed of the image receiving tape provides a measure of the speed of the motor although, depending on the construction of any gear train between the motor and the drive for the image receiving tape, the speed of the image receiving tape may be higher or lower than the speed of rotation of the motor.

The monitoring means may be arranged to detect when a supply of image receiving tape is not present and to provide a signal indicative thereof.

The monitoring means may be arranged downstream of the printing means but is preferably arranged upstream thereof. Upstream of the printing means, the tape is under tension and accordingly there is less variation in its speed and position. Thus, more accurate speed and printing control can be achieved.

According to a third aspect of the present invention, there is provided a supply of image receiving tape arranged for use in a tape printing apparatus so that the image receiving tape can be driven past a print location and an image printed thereon, the image receiving tape comprising a continuous printing layer having a top printing surface for receiving a printed image and a rear adhesive surface and a continuous backing layer removable to uncover the rear adhesive surface of the top printing layer, the image receiving tape carrying along its length regularly spaced detectable markings to provide an indication of the speed at which the image receiving tape is driven past the printing location or an indication of a characteristic of the image receiving tape.

Preferably, the markings comprise a plurality of evenly spaced lines. The marking may be of a contrasting color to the color of the surface of the image receiving tape on which the markings are provided. The markings provided on the image receiving tape may be detectable by electromagnetic radiation. Alternatively, the markings may be magnetic. The magnetic markings may be defined by magnetic ink or the image receiving tape may include a magnetic strip on which the markings are defined. The markings may be provided on the surface of the image receiving tape on which an image is printed. Such markings are preferably invisible. However, the markings are preferably provided on the continuous backing layer. The location of markings on the backing layer may make it easier for the tape printing apparatus in which the supply is received to detect the markings, without interfering with the printing means. Additionally, if the markings are in any way heat sensitive, they are less likely to be effected if they are on the continuous backing layer which is further from the thermal print head than the layer on which the image is defined.

The supply of image receiving tape may be housed in a cassette. Preferably, at least one of the following marking parameters is used to provide information on the characteristics of the tape:

marking pitch; marking color; marking thickness; and marking reflectivity.

Preferably, a characteristic parameter of the markings is changed near an end of the image receiving tape to provide an end of tape indication.

According to a fourth aspect of the present invention, there is provided in combination, a tape printing apparatus for printing an image on an image receiving tape and a supply of image receiving tape, the image receiving tape comprising a surface for receiving a printed image and carrying along its length regularly spaced detectable markings, the tape printing apparatus comprising:

input means for inputting data defining an image to be printed on the image receiving tape;

receiving means in which the supply of the image receiving tape is received;

printing means for printing an image on the image receiving tape in accordance with the input data, the printing means being controlled by control means;

a drive system operable to drive the image receiving tape past the printing means; and means for monitoring characteristics of the tape, whereby the monitoring means is arranged to detect the markings provided on the image receiving tape and provide a signal indicative of a parameter with which the markings move past the printing means, the monitoring means being connected to the control means for the print head so that the printing means is controlled in dependence on the characteristics of the image receiving tape.

According to a fifth aspect of the present invention, there is provided in combination, a tape printing apparatus for printing an image on an image receiving tape and a supply of image receiving tape, the image receiving tape comprising a surface for receiving a printed image and carrying along its length regularly spaced detectable markings, the tape printing apparatus comprising:

input means for inputting data defining an image to be printed on the image receiving tape;

receiving means in which the supply of the image receiving tape is received;

printing means for printing an image on the image receiving tape in accordance with the input data, the printing means being controlled by control means;

a drive system operable to drive the image receiving tape past the printing means; and means for monitoring the speed of the image receiving tape, whereby the monitoring means is arranged to detect the markings provided on the image receiving tape and provide a signal indicative of the speed at which the image receiving tape moves past the printing means, the monitoring means being connected to the control means for the print head so that the printing means is controlled in dependence on the speed of the image receiving tape.

According to a sixth aspect of the present invention, there is provided a method of operating a method of operating a tape printing apparatus comprising input means for inputting data, receiving means for receiving a supply of image receiving tape and printing means for printing an image on image receiving tape, the method comprising the steps of:

inputting data defining the image to be printed via the input means;

driving the image receiving tape past the printing means;

detecting markings provided on the image receiving tape to thereby determine a characteristic of the image receiving tape; and controlling the printing of the image on the image receiving tape by the printing means in dependence on the characteristic of the image receiving tape.

According to a seventh aspect of the present invention, there is provided a method of operating a tape printing apparatus comprising input means for inputting data, receiving means for receiving a supply of image receiving tape and printing means for printing an image on image receiving tape, the method comprising the steps of:

inputting data defining the image to be printed via the input means;

driving the image receiving tape past the printing means;

detecting markings provided on the image receiving tape to thereby determine the speed of the image receiving tape; and controlling the printing of the image on the image receiving tape by the printing means in dependence on the speed of the image receiving tape.

According to a eighth aspect of the present invention, there is provided a tape printing apparatus for printing an image on an image receiving tape comprising:

means for receiving a supply of image receiving tape;

printing means for printing an image on the image receiving tape;

detecting means for detecting markings provided on the image receiving tape, the markings providing information on at least one characteristic of the image receiving tape, the detecting means comprising a source of electromagnetic radiation, a detector and a grating.

Preferably, the grating is provided between the detector and the image receiving tape.

The at least one characteristic of the tape includes one or more of the following characteristics:

tape speed; tape width; tape size; tape color; and printing method required to print an image for example whether or not an ink ribbon is required or if the image receiving tape is a direct thermal material.

According to a ninth aspect of the present invention, there is provided a tape printing apparatus for printing an image on an image receiving tape comprising:

means for receiving a supply of image receiving tape and an ink ribbon for providing an image on the image receiving tape;

printing means for printing an image on the image receiving tape using the ink ribbon;

detecting means for detecting markings provided on the ink ribbon, the markings being arranged to provide information on a characteristic of the ribbon; and control means for controlling the tape printing apparatus in accordance with the detected ink ribbon characteristic.

The ink ribbon characteristic may be the speed of the ink ribbon; the colour of the ink ribbon; size of the ink ribbon; and/or any other property of the ink ribbon.

For a better understanding of the present invention and as to how the same may be carried into effect, reference will now be made by way of example to the accompanying drawings

DESCRIPTION OF THE PREFERRED EMBODIMENTS

Figure 1:
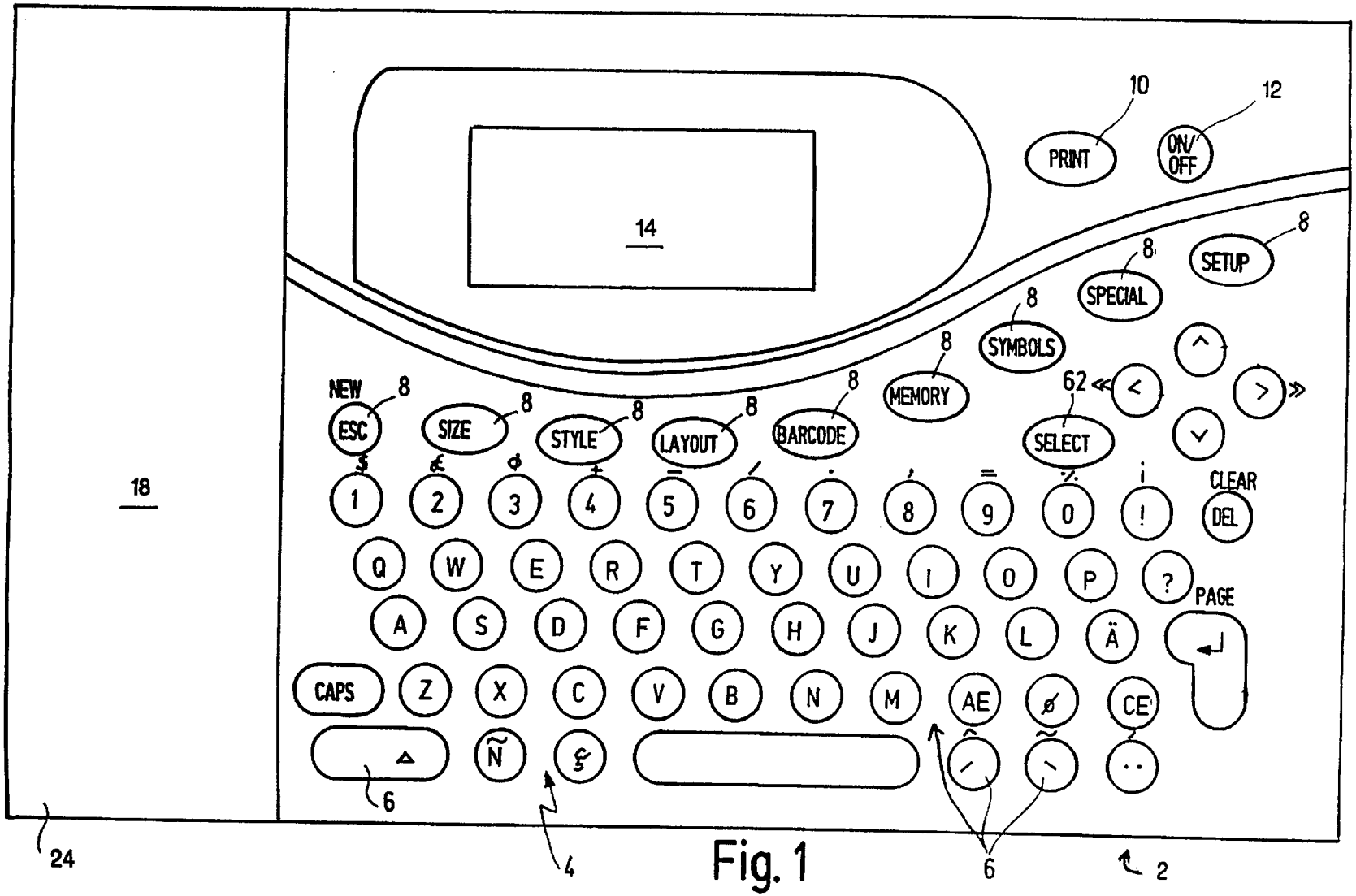
FIG. 1 is a plan view showing the upper surface of a tape printing apparatus.

FIG. 1 shows a plan view of a tape printing apparatus 2. The tape printing apparatus 2 comprises a keyboard 4. The keyboard 4 has a plurality of data entry keys and in particular comprises a plurality of numbered, lettered and punctuation keys 6 for inputting data to be printed as a label and function keys 8 for editing the input data. The keyboard 4 also comprises a print key 10 which is operated when it is desired that a label be printed. Additionally, the keyboard 4 has an on/off key 12 for switching the tape printing apparatus 2 on and off.

A liquid crystal display (LCD) 14 is provided to display the data as it entered. The display 14 allows a user to view all or part of the label to be printed which facilitated the editing of the label prior to its printing. The display 14 is also arranged to display various editing options which may be selectable by the user, for example using the function keys 8. Additionally, the display 14 can also display messages to the user. The display 14 is driven by a display driver 16 which can be seen in FIG. 3.

Figure 2:
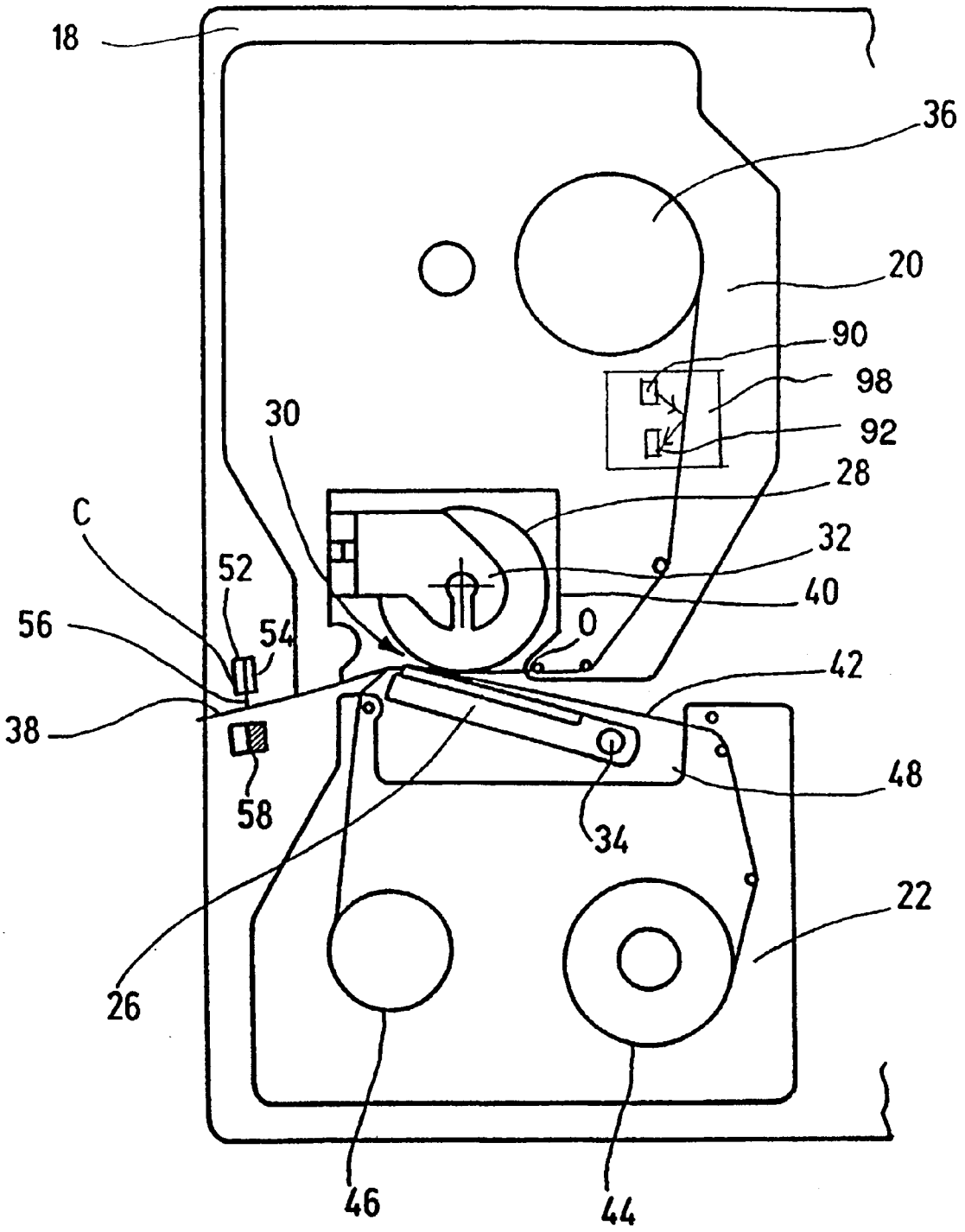
FIG. 2 is a view showing two cassettes inserted in the tape printing apparatus of FIG. 1.

Next to the keyboard 4 of the tape printing apparatus 2, there is a cassette receiving bay 18 which is arranged to receive two cassettes 20 and 22 which are shown in FIG. 2. The cassette receiving bay 18 has a lid 24 which is normally closed. FIG. 2 shows the interior of the cassette receiving bay 18 with the lid 24 removed. The cassette receiving bay 18 includes a thermal print head 26 and a platen 28 which cooperate to define a print zone 30. The platen 28 is mounted for rotation within a cage moulding 32. The print head 26 is pivotable about a pivot point 34 so that it can be brought into contact with the platen 28 for printing and moved away from the platen 28 to enable the cassettes 20 and 22 to be removed and replaced.

The first cassette 20 holds a supply spool 36 of image receiving tape 38. The image receiving tape 38 comprises a continuous upper layer for receiving a printed image on one of its surfaces and has its other surface coated with an adhesive layer to which is secured a continuous releasable backing layer. The image receiving tape 38 is guided by a guide mechanism (not shown) through the cassette 20, out of the cassette 20 through an outlet O past the print zone 30 to a cutting location C. The platen 28 is accommodated in a recess 40 of the first cassette.

An opening 98 is provided in the first cassette 20 for accomodating a sensor arrangement comprising a source 90 of electromagnetic radiation and a detector 92. This sensor arrangement will be described later with regard to FIG. 5. It is mounted to the frame of the printer 2, and allows detection of markings 70 (see FIG. 4) on the image receiving tape 38.

The second cassette 22 has a supply of ink ribbon 42 on an ink ribbon supply spool 44 and an ink ribbon take up spool 46. The second cassette 22 also has a recess 48 for receiving the print head 26. The image receiving tape 38 and the ink ribbon 42 are arranged to pass in an overlap manner between the print head 26 and the platen 28. In particular, the image receiving layer of the image receiving tape 38 is in contact with the ink ribbon 42. The ink ribbon 42 is a thermal transfer ribbon which when in contact with the activated or heated elements of the thermal print head 26 defines an image on the image receiving tape 38.

As will be described in more detail hereinafter, the platen 28 is driven by a dc motor 50 (see FIG. 3) so that it rotates to drive the image receiving tape 38 in a direction which is parallel to the lengthwise extent of the image receiving tape 38 through the print zone 30. In this way, an image is printed on the image receiving tape 38 and the image receiving tape 38 on which an image has been printed is fed from the print zone 30 to the cutting location C. The rotation of the platen 28 also causes the ink ribbon 42 to be driven from the ink ribbon supply spool 44, past the print head 26 and to the ink ribbon take up spool 46.

A cutting arrangement 52 is provided at the cutting location C which includes a cutter support member 54 carrying a blade 56. The blade 56 acts against an anvil 58 to cut a printed label from the supply of image receiving tape 38.

Figure 7:
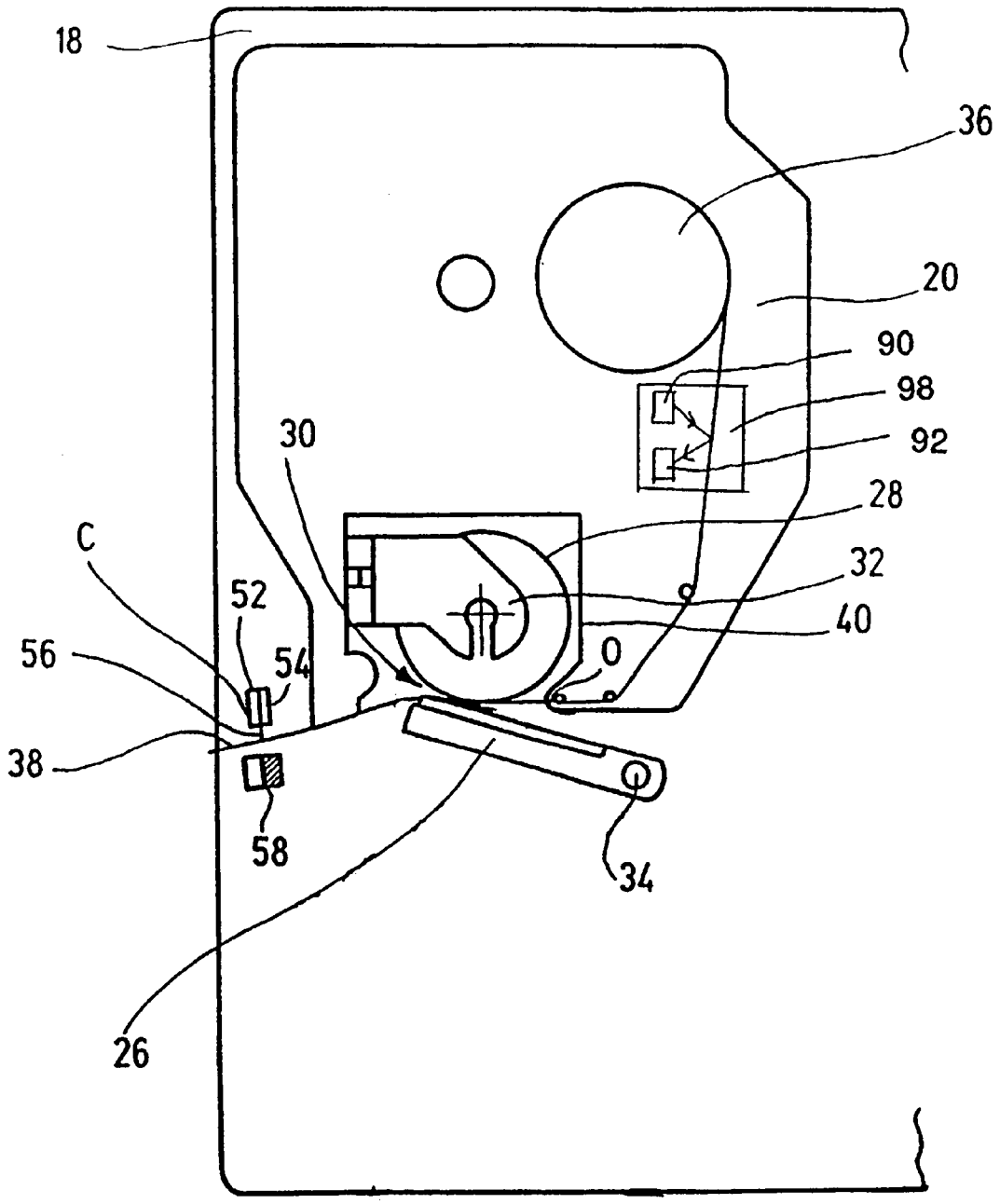
FIG. 7 shows a plan view of a single cassette inserted in a tape printing apparatus wherein markings are identifying a characteristic of the tape.
Figure 8:
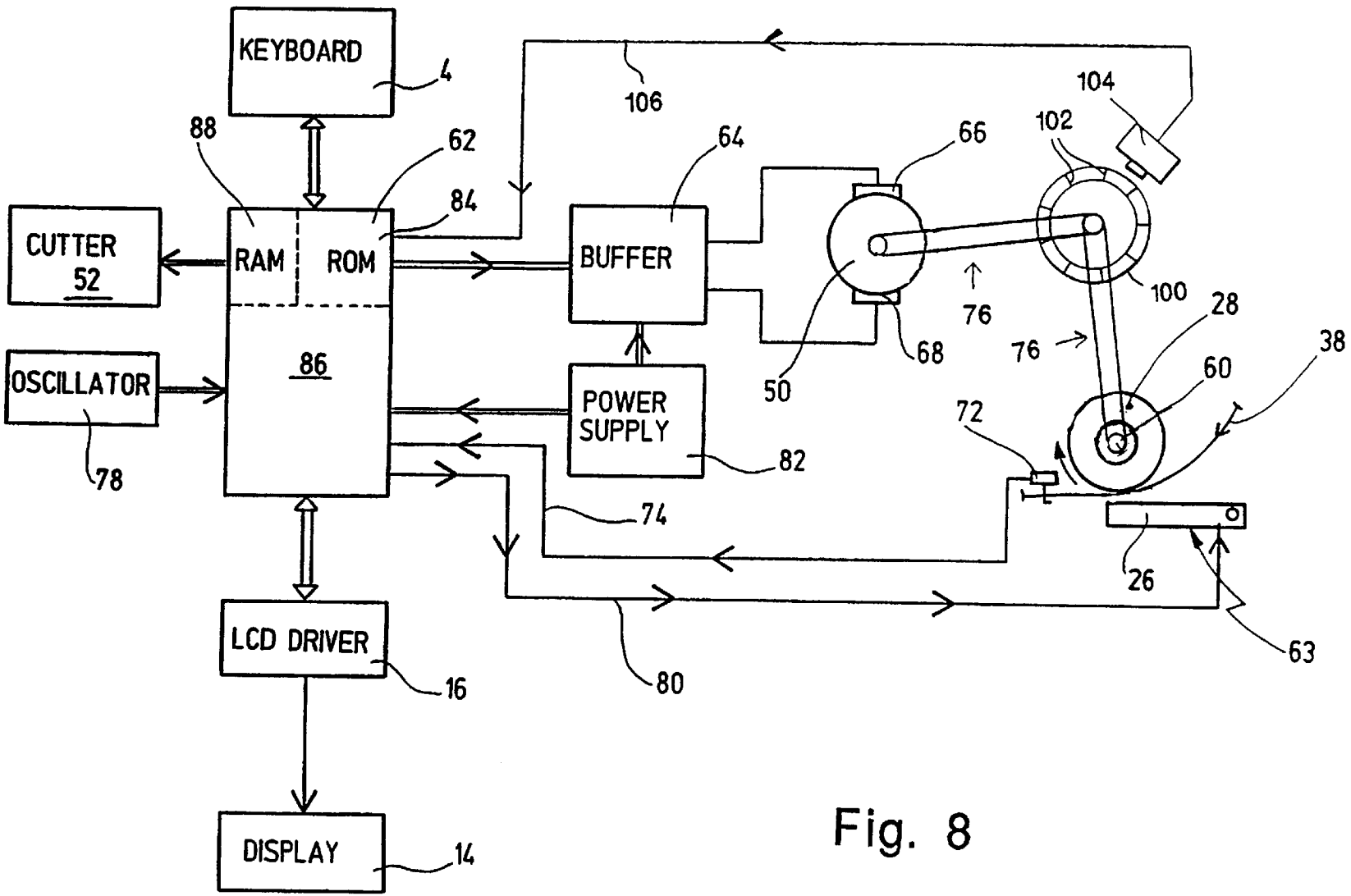
FIG. 8 is a schematic view showing the elements of a drive system of the printing apparatus according to FIG. 7.

The print head 26 is a thermal print head comprising a column of a plurality of printing elements. The print head 42 is preferably only one printing element wide and the column extends in a direction perpendicular to the lengthwise direction of the image receiving tape 38. The height of the column of printing elements is preferably equal to the width of the image receiving tape 38 to be used with the tape printing apparatus. With embodiments of this invention, where more than one width of image receiving tape 38 is used, the print head column will generally have a height equal to the largest width of image receiving tape 38. An image is printed on the image receiving tape 38 column by column by the print head 26. This will be described in more detail hereinafter. It should be appreciated that an image can be printed on the image receiving tape via the ink ribbon 42. Alternatively, if the image receiving tape 38 is of a suitable thermally sensitive material, an image can be applied by the print head 26 directly to the image receiving tape 38. No ink ribbon 42 would then be required with a thermally sensitive image receiving tape 38, as shown in FIGS. 7 and 8.

It should also be appreciated that in some embodiments of the present invention, the tape printing apparatus 2 can be arranged to have two different modes of operation. In the first mode of operation, an image is applied directly by the print head 26 to the image receiving tape 38 whilst in the second mode of operation, an image is applied to the image receiving tape 38 via an ink ribbon 42. Alternatively, the tape printing apparatus 2 may be arranged to print an image on the image receiving tape 38 only by directly applying an image to a thermally sensitive image receiving tape. This latter tape printing apparatus would then not have a mode of operation in which an ink ribbon is used to define an image.

In some embodiments, the print head 26 may have a height which may be slightly less than the width of largest image receiving tape 38 which can be used with a tape printing apparatus 2. This is because an image printed on the image receiving tape 38 will usually have upper and lower blank margins. The print head 26 may then have a height corresponding to the largest width of image receiving tape 38, less the height of the upper and lower margins.

As an alternative to the two cassette systems shown in FIG. 2, the cassette receiving bay may be arranged to receive a single cassette having both the image receiving tape 38 and the ink ribbon 42. The ink ribbon 42 can be dispensed with for those embodiments which are capable of printing an image directly on thermally sensitive image receiving tape 38. It should be appreciated that any suitable arrangement for providing a supply of image receiving tape and/or ink ribbon can be used with embodiments of the present invention.

Figure 3:
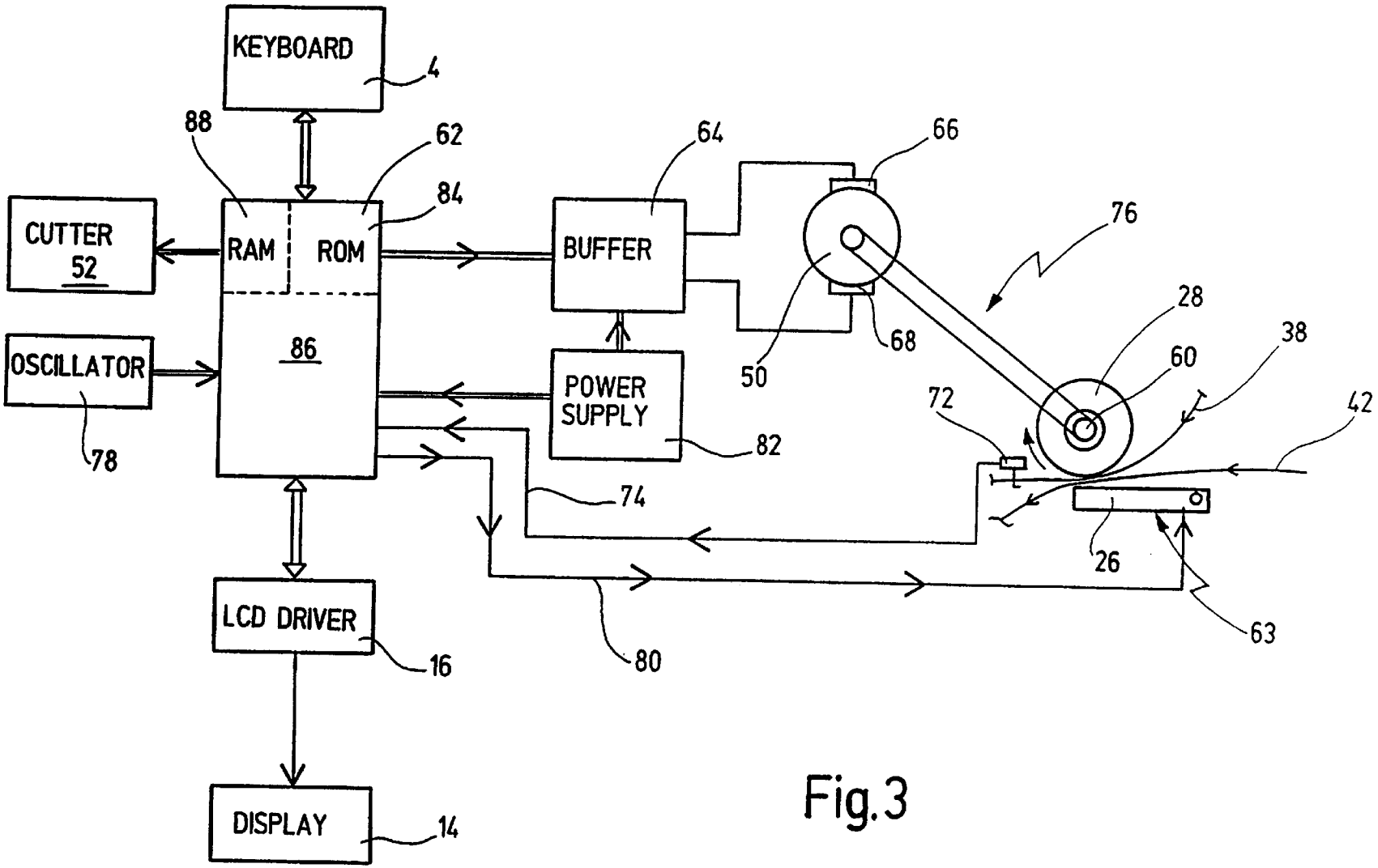
FIG. 3 is a schematic view showing the elements of a drive system embodying the present invention.

FIG. 3 shows the elements of a drive system according to one embodiment of the present invention. For clarity, only the platen 28 and print head 26 are shown along with portions of the image receiving tape 38 and the ink ribbon 42. The cassettes 20 and 22 for housing the ink ribbon 42 and the image receiving tape 38 are not shown in this Figure. The platen 28 is mounted for rotation about an axis 60 extending through the plane of the paper. The platen 28 rotates in the direction of arrow A. As can be seen from FIG. 3, the ink ribbon 42 and the image receiving tape 38 pass in an overlap manner between the platen 28 and the print head 26. As discussed previously, a dc motor 50 is provided. This is driven from a microcontroller in the form of a microprocessor chip 62 via a current buffer 64 using pulse width modulation to approximate a linear control voltage for the dc motor 50 at its terminals 66 and 68. As is well-known, a dc motor rotates continuously at a speed related to the applied voltage. The rotation is continuous and not stepwise.

Figure 4:
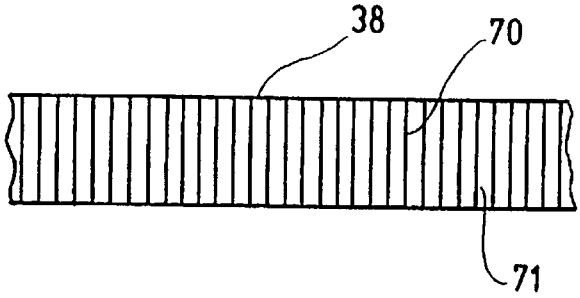
FIG. 4 is a schematic view of the rear surface of an image receiving tape embodying the present invention.

As can be seen from FIG. 4, the reverse surface (the surface opposite that to which the image is applied) of the image receiving tape 38 is provided with a plurality of markings in the form of parallel lines 70 which are evenly spaced apart along a substantial portion if not the entire length of the image receiving tape 38. In one preferred embodiment, the width of each line 70 is the same in each space 71 provided between adjacent lines 70. The surface on which the lines 70 are arranged may be provided by the releasable backing layer of the image receiving tape 38. A sensor arrangement 72 is arranged to supply a pulse to the microprocessor chip 62 via feedback line 74 each time one line 70 passes the sensor arrangement 72. The platen 28 is connected via gear train 76 (shown only schematically) to motor 50. Accordingly, rotation of the motor 50 drives the platen 28 which in turn drives the image receiving tape 38. Thus, the speed of the image receiving tape 38 is indicative of the speed of the motor 50. The microprocessor chip 62 can therefore determine the speed of the motor 50 by measuring the frequency of the pulses fed back to it along line 74 from the sensor arrangement 72. Alternatively or additionally, the microprocessor chip 62 can determine the pitch of the lines 70 on the image receiving tape 38 from the frequency of the signals provided by the sensor arrangement, when the speed of the motor is known. The speed of the motor can be determined by means of an encoder on the shaft of the motor, or when the motor is a stepper motor. The sensor arrangement 72 will be described in more detail hereinafter.

A crystal oscillator 78 provides reference clock cycles for the microprocessor chip 62. The microprocessor chip 62 supplies print data along line 80 to the thermal print head 26 which has a storage register and a shift register (not shown). The storage register is separate from the shift register and arranged in parallel thereto. Data is transferred to the print head 26 serially, clocked bit by bit under the control of the microprocessor chip 62 to the shift register contained in the print head 63. At the end of the transfer of a column of pixel data, the data is latched into the storage register under command from the microprocessor chip 62. The storage register will hold this data until the next latching operation of the new shift register contents into the storage register. Later, the print head 26 is "strobed" by the microprocessor chip 62 to turn on high current output drivers in parallel which deposit melted ink from the ink ribbon 42 onto the image receiving tape 38 in pixel patterns according to data held in the storage register. With a thermally sensitive image receiving tape 38, the heated printing elements are in direct contact with the image receiving tape 38. Clocking of data into the shift register can occur whilst a strobe signal causes printing of the data in the storage register, but it should be appreciated that this operation need not occur in this way since the two operations are independent.

As explained above, the thermal print head 26 has a column of printing elements which are printed as a vertical line on the image receiving tape 38. A character is thus printed by printing a number of adjacent and slightly overlapping columns containing different pixel data on the image receiving tape 38 as it moves past the print head 26. Thus, an image is defined on the image receiving tape 38 as the groups of pixel data are sequentially printed adjacent one another in the direction in which the image receiving tape 38 is driven past the image receiving tape 38. Accordingly, the microprocessor chip 62 provides print strobe signals. On each print strobe signal, the column of data held in the storage register is printed.

In some embodiments of the present invention, the print head is divided into a plurality of groups which are not operated at the same time. With this embodiment a separate strobe signal would be required for the data for each group of printing elements of the print head. Thus, if the print head is divided into three separate groups then three strobe signals will be required. As described hereinafter, each strobe signal may only be provided when, for example two or more lines are detected. Thus, if the print head is divided into more than one group, an increased number of signals from the sensing arrangement is required for each print cycle. This means that the number of lines per inch on the image receiving tape may need to be increased. The arrangement hereinafter described which uses a magnetic strip may be particularly appropriate.

In FIG. 3, reference numeral 82 denotes a power supply for the current buffer 64 and the microprocessor chip 62. The power supply can be mains or batteries.

The speed of the dc motor 50 is controlled by the microprocessor chip 62 using an algorithm which measures the number of reference clock cycles from the crystal oscillator 78 between successive pulses supplied by the sensor arrangement 72 to the microprocessor chip 62 along feedback line 74. The value obtained from this measurement is used to calculate the speed of the motor 50 and this in turn is used to alter the pulse width of the pulse width modulated drive signal to the current buffer 64 to adjust the motor drive in a manner so as to hold the speed constant.

The dc motor 50 is arranged to have a speed of rotation at an approximately constant level. By measuring the speed of the image receiving tape 38 or the motor 50 with the mentioned encoder on the motor shaft, it is possible to determine approximately the speed of rotation of the dc motor 50. The microprocessor chip 62 controls the speed of rotation of the dc motor 50 by causing a maximum drive to be applied to the do motor 50 if the determined speed of the image receiving tape falls below a first predetermined value, no drive if the speed exceeds a second predetermined value and a linear drive versus speed characteristic if the determined speed for the image receiving tape falls between the first and second predetermined values. This results in a simple speed control of the motor. Clearly as the microprocessor chip 62 has knowledge of the approximate motor speed at all times, it can take appropriate action if the speed is outside certain limits.

The fact that there is only a somewhat coarse control of the speed of the dc motor 50 is not a disadvantage in embodiments of the present invention for the reason that print strobe signals which control the printing of each column of data and the supply of the next column of data to the print head 26 is made responsive to the signals supplied by the sensor arrangement 72 to the microprocessor chip 62. On each data strobe signal supplied to the print head 26, a column of data stored in the storage register of the thermal print head 26 is printed. At the next strobe signal, the next column of data which has been transferred to the storage register from the shift register is printed. In this way, the deposition of the image on the image receiving tape 38 is related to the motion of the image receiving tape 38. With embodiments of the present invention, significant speed variations have a negligible effect on print quality, as the print strobe signals supplied to the print head slow down or speed up in response to the actual speed of the image receiving tape.

In summary, the determined speed of the image receiving tape 38 is used to control tho printing of an image on the image receiving tape 38 and also to control the speed of the motor 50. This has the benefit that it is not necessary to have a complicated and potentially costly controller for accurate speed control. The system can therefore be implemented in a low cost general purpose microprocessor chip with little overhead to distract it from other tasks, such as handling the print data itself.

The microprocessor chip 62 has a read only memory (ROM) 84, a microprocessor portion 86 and random access memory capacity indicated diagrammatically by RAM 88. The microprocessor 86 is controlled by programming stored in the ROM 84 and when so controlled acts as a controller. The microprocessor chip 62 is connected to receive label data input to it via the keyboard 4. The microprocessor chip 62 outputs data to drive the display 14 via the display driver 16 to display a label to be printed (or a part thereof) and/or messages or instructions for the user. The display driver 16 may alternatively form part of the microprocessor chip 62. The microprocessor chip 62 may also control the cutting arrangement 52 to allow lengths of image receiving tape 38 to be cut off after an image has been printed thereon.

The microprocessor chip 62 generates pixel data in accordance with data input via the keyboard 4. As mentioned hereinbefore, this pixel data is transmitted column by column to the print head 26.

Figure 5A:
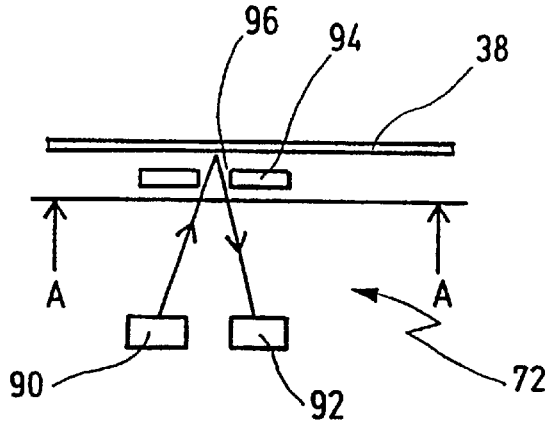
FIG. 5*a* shows a more detailed schematic view from above of a sensor arrangement, shown in FIG. 3.
Figure 5B:
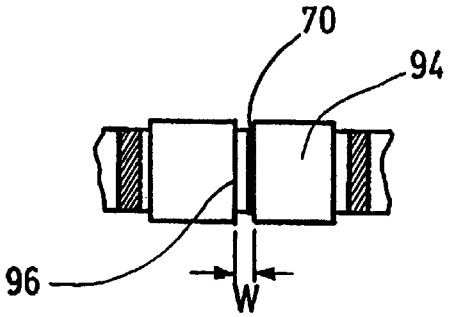
FIG. 5*b* shows a schematic cross-sectional view along line A—A of FIG. 5*a;*

Reference will now be made to FIGS. 5*a* and 5*b* which show a schematic view of the sensor arrangement 72. The sensor arrangement 72 comprises a light source 90 which may be a light emitting diode and a light detector 92 which may be in the form of a photo transistor. The photo transistor 92 is arranged to detect light emitted by the light source 90 which is reflected from the rear surface of the image receiving tape 38, that is the surface on which the lines 70 are provided. The lines 70 will normally be much darker than the background 71 of the image receiving tape 38. Accordingly, more light will be reflected from the lighter regions 71 between the lines 70 on the rear of the image receiving tape 38 to the photo transistor 92. Conversely, when the light from the light emitting diode 90 impinges on a line 70, which is darker than the background of the image receiving tape, much less light (if any) will be reflected back to the photo transistor 92.

Figure 6:
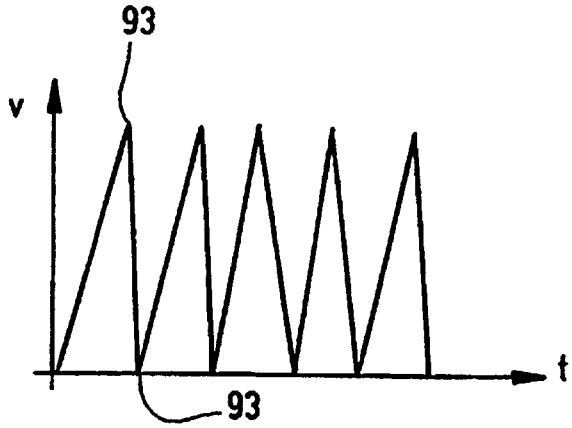
FIG. 6 shows a signal produced by the sensor arrangement shown in FIG. 3.

The use of a grating 94 having a single slit 96 extending across the width of the image receiving tape 38 is advantageous in that a higher quality wave form is provided by the photo transistor 92, such as shown in FIG. 6. The width W of the slit 96 is selected so as to have a width generally corresponding to the width of a single line 70. The space or light regions 71 preferably each have a width equal to that of a single line 70. However, this is not essential. The spaces or light regions 71 may have a width greater or less than that of each line 70. Thus, the dimensions of the slit 96 corresponds generally to the dimensions of a single line. When the slit 96 is positioned centrally over a line 70, only the line 70 can be seen through the slit 96. In FIG. 5*b*, a line 70 is partially shown behind the slit as the line 70 is no longer centred on the slit 96. The provision of the grating improves the contrast between the light regions 71 and dark regions defined by the lines 70 on the image receiving tape 38. This provides sharper peaks 93 and troughs 95 in the wave form provided by the photo transistor 92, as shown in FIG. 6. As will be appreciated, the microprocessor chip 62 uses the time between successive peaks 93 or troughs 95 to make a determination of the speed of the image receiving tape 38. One of the peaks 93 and troughs 95 will represent the passing of lines 70 past the grating 94 whilst the other of the peaks 93 and troughs 95 will represent the passing a light region 71 past the grating 94.

In one modification to the above described grating, a plurality of slits are provided. The spacing between adjacent slits corresponds to the distance between adjacent markings on the image receiving tape. In other words, the pitch of the slits is the same as that of the lines 70 and the light regions or spaces 71. This modification has the advantage that more light is transmitted back to the detector as compared to embodiments which only use a single slit. Thus, less sensitive and hence cheaper detectors can be used.

In another modification to the above-described arrangement the grating opening need not be of the same width as the lines 70 and the spaces 71 between those lines. In particular, the grating opening width may be smaller than the width of the lines 70 or the width of the spaces 71 therebetween.

The grating is generally arranged between the image receiving tape and the detector. However, in some embodiments, the grating may be arranged on the opposite side of the image receiving tape to the detector. This arrangement may be used if the source and detector are on opposite sides of the image receiving tape.

In one preferred embodiment of the present invention, a data strobe signal for controlling the print head 26 can be produced by the microprocessor 62 for each peak 93 or trough 95 detected by the sensing arrangement 72. Alternatively, a data strobe signal can be produced for every two peaks 93 or troughs 95 provided by the sensing arrangement 72 or for any other integral number of peaks 93 or troughs 95. On each data strobe signal, a column of data stored in the storage register of the thermal print head 26 is printed. At the next strobe signal, the next column of data which has been transferred to the storage register from the shift register is printed. In this way, the printing of the image on the image receiving tape 38 is related exactly to the motion of the tape.

Typically, tape printing apparatus may print with a resolution of 180 dots per inch (dpi). Thus if two pulses (two peaks or two troughs) are required from the sensing arrangement 72 for each strobe pulse, the lines 70 would need to be printed on the back of the image receiving tape along the length thereof with a resolution of 360 dots per inch. In other words, 360 lines would need to be printed on each inch of image receiving tape 38. Alternatively, if only one pulse were to be provided for each strobe pulse, the lines would have to be printed with a resolution of 180 dots per inch. If only a single pulse (one trough or one peak) from the sensor arrangement 72 is provided for each strobe signal, it is advantageous if the motor were to be run at a higher speed as compared to embodiments where two pulses are provided by the sensing arrangement 72 for each strobe signal. This is because at greater motor speeds, the motor becomes easier to control and a single motor drive pulse per print cycle may be sufficient to control the motor. This is because the signal provided by the sensor arrangement is used to control not only printing but also the motor speed.

In one variation on the present invention, the lines 70 could be printed on the image receiving tape 38 with magnetic ink and magnetic sensors would be used to detect the lines, in an analogous way to that described in relation to the embodiment shown in FIG. 5. The magnetic markings on the tape could be detected using a magnetic proximity detector. The magnetic proximity detector may comprise a coil wound around a bar magnet. If a magnetic object such as a fine 70 defined by magnetic ink is moved past a pole of the magnet, the flux changes and a current is induced in the coil. Thus, each time a line 70 defined by magnetic ink moves past the coil, a pulse of current would be induced in the sensor coil. The number of pulses can be counted in a similar way to the pulses described in relation to the previous embodiment.

In a further modification to the present invention, a continuous magnetic strip could be attached to the rear of the image receiving tape 38. Markings in the form of "lines" could then be recorded onto the strip. Those lines are defined by recording flux reversals onto a magnetic strip. The resolution could vary between 100 flux reversals per inch to between 10,000 to 15,000 flux reversals per inch i.e. up to 600 "lines" per millimetre. A higher resolution can therefore be obtained using such a magnetic strip. These magnetic markings can be detected using a magnetic head of the type used in audio or data recording reading equipment. Such magnetic heads are well-known and will not be described here.

The degree of resolution (number of markings per inch) required will depend on a number of factors. In particular, the required resolution depends on the number of dots printed by the print head per inch along the length of the image receiving tape as well as the number of signals which need to be provided by the sensing sensor arrangement 72 for each strobe signal.

FIGS. 7 and 8 show a tape printer 2 capable of printing onto a direct thermal tape medium serving as image receiving tape 38. In FIGS. 7 and 8, same elements are denoted with like reference numerals. The ink ribbon cassette 22 and the ink ribbon 42 shown in FIGS. 2 and 3 are removed. Another important difference shown in FIG. 8 is that an additional feedback line 106 connected to the microprocessor 86 is coupled to an encoder arrangement which measures the speed of the dc motor 50. The motor 50 is coupled via a gear train 76 with a rotatably supported disc 100 provided with markings 102. Another gear train 76 connects the disc 100 with the shaft 60 of the platen 28. An optical detector 104 is provided for detecting the markings 102 on disc 100. Consequently, the encoder arrangement consisting of disc 100 with markings 102 and detector 104 gives a pulse every time the a marking 102 is detected. Thus, the motor speed is being measured. Consequently, the microprocessor gets two inputs, the first one (line 106) giving an information about the speed of the motor 50, and the second one (line 74) containing an information about the frequency (and amplitude and waveform) with which markings 70 on the tape 38 are detected. Consequently, it is possible to use the markings 70 for detecting a characteristic of the image receiving tape. Consequently, eg. the pitch of the markings 70 can be used for detecting a characteristic of the image receiving tape, and for controlling the printing mechanism accordingly. In other words, the signal from the sensing arrangement 72 provides an indication of a characteristic of the image receiving tape 38. Consequently, it would be possible to identify the width of the tape 38 and to control the printing mechanism accordingly, ie. to size characters such that they fit onto the tape. It should be noted that a stepper motor could be provided instead of the dc motor 50, thus allowing to dispense with the disc 100 and the detector 104. Further, when a grating 94 is used in this embodiment of the invention, it is proposed to have multiple gratings 94 and detectors 92, wherein each grating has a different distance between its openings. Each grating 94 is then assigned to a predetermined type of tape 38, whereby each type of tapes has a pitch of markings 70 corresponding to the distance between the openings of the assigned grating 94.

In one modification of the present invention, an end of image receiving tape condition can be simply detected. In particular, at or near the end of the image receiving tape there may be no lines or markings. The absence of pulses (peaks or troughs) in the signal from the sensor arrangement 72 could be noted so that an end of tape condition could be determined by the microprocessor chip 62. The print head 26 would then be controlled to stop printing. A message advising the user of an end of tape condition can of course be displayed on the display 14.

In one preferred modification to the above embodiments, the pitch of the lines or markings on the tape is reduced or increased at or near the end of the tape. There is preferably a significant difference between the normal pitch and the pitch of the lines or markings near the end of the tape. The microprocessor chip 62 would be able to detect this difference in pitch from the increased or decreased number of signals which it receives from the sensor arrangement and determines that an end of tape condition exists. This variation has the advantage that the microprocessor chip 62 is able to distinguish between end of tape conditions and a motor stall resulting from a tape jamming.

In one modification of the present invention, the signal provided by the sensing arrangement 70 along line 74 can provide an indication to the microprocessor chip 62 of a motor stall condition (that is no rotation of the motor even with an applied voltage) or a partial stall, which could be due to faults such as a tape jam or a mechanism failure, or due to the end of the tape being reached. Thus, the apparatus can be used to provide an end of tape indication where the image receiving tape 38 is secured to its tape supply reel and is optionally provided with high friction material at its end so that the end of tape condition is manifested by a motor stall or partial stall. The stall condition is easily determined by the microprocessor chip 62 in that no pulses (peaks or troughs) are provided by the sensor arrangement 72. Where high friction material is provided at the end of the image receiving tape 38, the high friction material is in contact with the platen 28 and causes the motor 50 to slow down and, finally, to stall because the end of image receiving tape 38 is secured to its supply reel and cannot move. The image receiving tape 38 is no longer driven, which is detected by the sensor arrangement 72. Thus, a signal indicating that there is an end of tape condition is sent via line 74 to the microprocessor chip 62. In this latter embodiment, markings may be provided along the entire length of image receiving tape including on the end region of the image receiving tape.

It should be appreciated that the line pitch, line thickness, line color, line reflectivity or indeed any other characteristic of the markings provided on the image receiving tape can be varied depending on the characteristic of the tape contained in the cassette 22. By varying the line pitch, fine thickness, line color or line reflectivity, information relating to color, tape width, and/or the nature of the image receiving tape (i.e. whether or not an ink ribbon is required) can be encoded on to the tape. The microprocessor chip 62 determines the relevant characteristic of the lines or markings and can thus determine the characteristics of the image receiving tape present in the cassette receiving bay.

Variations for example in line pitch could be detected by a grating having a single opening. Preferably, the variation in line pitch would be small as changes in the line pitch would result in a proportional change in the motor and print speeds. The change in the motor speed may be detected by monitoring the current drawn by the motor, this being indicative of the motor speed. The current drawn by the motor would thus provide an indication of the line pitch and hence the information on the tape characteristics can be determined.

In a more preferred variation, the width of the lines, the color and/or the reflectivity of the lines is varied. The overall timing information in the waveform received by the microprocessor chip would be unchanged, but the form of the signal provided by the sensing arrangement would change. In other words, the frequency of the signals would be unchanged but the waveform would differ with different colored lines, different widths of line or different line reflectivities. The change in the form of the signal provided by the sensing arrangement can be detected and used to determine the nature of the tape in the cassette.

The above-described line variations can be used to determine one or more of the following tape characteristics; tape width, tape color, nature of tape, i.e. thermally sensitive tapes or tape requiring an ink ribbon.

It should be appreciated that the width, color, reflectivity of the lines could be changed near the end of tape so that an end of tape condition can be detected.

Additionally, the markings on the rear of the image receiving tape 38 can be used to define positions on the image receiving tape. This can be important in embodiments of the present invention where the tape has to be driven back into the tape printing apparatus 2 and driven past the print head a number of times, for example as might be required to achieve color printing. Good quality color printing would depend on the accurate re-positioning of the print head at the defined beginning or start of the label before each pass of the same portion of the image receiving tape past the print head. This ensures that each differently colored image overlies exactly the preceding printed images. The accurate repositioning is achieved by counting the number of lines or markings which pass the print head when an image is printed and then counting exactly the same number of lines or markings when driving the tape printing apparatus in the reverse direction. The reverse driving is then stopped and the tape driven again in the forward direction whilst the image in the next color is printed on an image receiving tape, over the image in the first color. Full color printing can be achieved by printing three images overlying each other in three different colors; cyan, magenta and yellow. An image can also be printed in black over the three images in cyan, magenta and yellow which may improve the quality of the full color image. It should be appreciated that this same technique can be used with any number of overlying images using any color. For example two tone printing could also be achieved using this technique.

It should be appreciated that the print head need not necessarily include shift registers and storage registers. Instead, the data could be passed for example directly to the thermal print head printing elements from the microprocessor chip.

In the specific embodiment described, the speed of the image receiving tape is used to make a determination of the speed of rotation of the motor. However, it should be appreciated that due to gearing, the speed of the image receiving tape may in fact be smaller or larger than the actual speed of rotation of the motor. However, the microprocessor chip can be programmed to take into account the actual difference in speed between the image receiving tape and the motor.

In the specific embodiment illustrated, the markings on the tape are described as being parallel dark lines on a lighter background. It should be appreciated that it would of course be possible to have markings in the form of light lines on a dark background. The distance between successive lines will of course depend on the required line resolution. In the preferred embodiment, a source of visible light is used as a light source and the light is reflected from the image receiving tape. However, it should be appreciated that any other suitable form of electromagnetic radiation can also be used, such as ultra violet light or infra-red radiation. Additionally, transmission of the electromagnetic radiation can be used to distinguish between the markings and their background. The markings described in the illustrated embodiment have been shown as parallel lines extending perpendicular to the length of the image receiving tape. However, the markings may take any suitable form such as dots or the like. If the markings are in the form of lines, the lines need not extend perpendicular to the length of the image receiving tape but may extend at an angle thereto.

In the embodiment illustrated in FIG. 3, the sensor arrangement 72 is arranged downstream of the print head and the platen. Thus, the portion of the image receiving tape which passes the sensor arrangement 72 may have an image printed thereon. It could of course be possible to arrange the sensor arrangement 72 upstream of the print head 26 and platen 28. Thus, the image receiving tape passing the sensor arrangement 72, in this modification, would not have an image printed thereon. This latter arrangement has the advantage that the tape is under tension upstream of the print head 26 and accordingly, the speed and position of the image receiving tape are less likely to vary.

In the various embodiments described, the motor is described as being a dc motor. However, it should be appreciated that any other suitable type of motor can be used with embodiments of the present invention.

In a modification of the present invention, the markings may be provided on the ink ribbon instead of the image receiving tape. Such an arrangement can be used if a sensor arrangement cannot be included in a position suitable for detecting markings on image receiving tape. The speed of the ink ribbon can be used as a measure of the speed of the image receiving tape. In some embodiments of the present invention, there may be advantages in measuring the speed of the ink ribbon itself.

In one modification of the above described embodiments, the nature of the image receiving tape is determined from the markings and the information on the image receiving tape is stored. The operation of the tape printing apparatus may be modified in accordance with the characteristics of the image receiving tape present in the tape printing apparatus. No further checks to determine the nature of the image receiving tape will be carried out until a condition is detected which may reflect a possible change in the image receiving tape. For example, the tape printing apparatus may be arranged to detect when the lid is opened. When the lid is subsequently closed, the tape printing apparatus may carry out checks in order to determine the nature of the image receiving tape. The opening and closing of the lid may be detected by means of a switch connected to the microprocessor. The switch could be, for example, closed when the lid was closed and open when the lid was opened. Alternatively, means may be provided in the cassette receiving bay to determine when a supply of image receiving tape has been removed and subsequently replaced if it is detected that a cassette of image receiving tape has been removed and replaced, then the checks to determine the nature of the image receiving tape can be carried out. A pressure switch may be provided in the cassette receiving bay to determine whether or not a cassette of image receiving tape is present or absent. Such a switch would of course be connected to the microprocessor.

What is claimed is:

1. A printing apparatus for printing an image on an image receiving tape, the apparatus comprising:

input means for receiving data defining an image to be printed on an image receiving tape;

receiving means for receiving a supply of the image receiving tape;

printing means for printing an image on the image receiving tape in accordance with the input data;

control means configured to control the printing means;

a drive system operable to drive the image receiving tape past the printing means; and monitoring means for monitoring the speed of the image receiving tape, the monitoring mean; being arranged to detect markings provided on the image receiving tape and to provide a signal indicative of the speed at which the image receiving tape moves past said printing means, the signal being supplied to the control means for controlling the printing means in dependence on the speed of the tape indicated by the signal.

2. A tape printing apparatus as claimed in claim 1, wherein the markings are detectable with electromagnetic radiation, and the monitoring means comprises a source of electromagnetic radiation and a detector arranged to detect electromagnetic radiation from said source, after the electromagnetic radiation from the source has interacted with the markings on the image receiving tape.

3. A tape printing apparatus as claimed in claim 2, wherein the electromagnetic radiation source comprises a light emitting device and the detector comprises a photo transistor.

4. A tape printing apparatus as claimed in claim 2, further comprising: a grating member arranged between the detector and the image receiving tape, the grating member having at least one opening.

5. A tape printing apparatus as claimed in claim 4, wherein each opening substantially corresponds in size and shape to a single marking.

6. A tape printing apparatus as claimed in claim 4, wherein the grating member has a plurality of openings, the spacing between adjacent openings of the grating member being substantially the same as the spacing between adjacent markings on the image receiving tape.

7. A tape printing apparatus as claimed in claim 1, wherein the monitoring means is operable to detect magnetic markings on the image receiving tape.

8. A tape printing apparatus as claimed in claim 7, wherein the magnetic markings are defined on the image receiving tape with magnetic ink and the monitoring means are arranged to detect the markings defined by the magnetic ink.

9. A tape printing apparatus as claimed in claim 8, wherein the magnetic markings comprise a plurality of lines formed by recording flux reversals onto a magnetic strip on the image receiving tape, the monitoring means being arranged to detect the lines defined on said magnetic strip.

10. A tape printing apparatus as claimed in claim 1, wherein at least one characteristic of the markings at or near an end of the image receiving tape is changed, said monitoring means being arranged to provide a signal indicative of the change in the markings to the control means so that an end of image receiving tape condition is determined by the control means.

11. A tape printing apparatus as claimed in claim 1, wherein the end of the image receiving tape is provided with means for resisting the separation from a supply reel for the image receiving tape, the monitoring means being arranged to provide a signal indicative of the reduction in speed of the image receiving tape caused by the means for resisting at the end of the image receiving tape so that an end of image receiving tape condition is determined by said control means.

12. A tape printing apparatus as claimed in claim 1, wherein the markings on the image receiving tape provide information as to the characteristics of the image receiving tape, said monitoring means being arranged to detect different markings on different types of image receiving tape and to provide a signal indicative of the different markings so that the characteristics of the image receiving tape are identifiable.

13. A tape printing apparatus as claimed in claim 12, wherein at least one of the following parameters varies in dependence on the characteristics of the image receiving tape pitch of markings; width of markings; color of markings; and reflectivity of markings, said monitoring means being arranged to provide a signal indicative of the parameters of the markings.

14. A tape printing apparatus as claimed in claim 12, wherein the characteristics of the image receiving tape comprise at least one of the following parameters:

tape width, tape background color, tape printing color, tape length, printing energy.

15. A tape printing apparatus as claimed in claim 12, wherein the control means is arranged to control the operation of the tape printing apparatus in accordance with the identified tape characteristics.

16. A tape printing apparatus as claimed in claim 1, wherein the drive system is arranged to drive the image receiving tape backwards after a first image has been printed thereon, and when the image receiving tape is driven forwards again by the drive system a second image is printed on the image receiving tape overlying the first image, the markings on the image receiving tape being used to position the image receiving tape so that the first and second images overlie on another.

17. A tape printing apparatus as claimed in claim 16, further comprising: counting means for counting the number of markings which pass a given location when the image receiving tape is driven past the printing means in the forwards direction and for counting the number of markings which pass the given location when the image receiving tape is driven backwards, said counting means being arranged to stop the driving of the image receiving tape in the backwards direction by the drive system when the number of markings which have passed the given location is substantially equal to the number of markings counted when the image receiving tape is driven past the printing means in the forwards direction.

18. A tape printing apparatus as claimed in claim 1, wherein the printing means comprises a thermal print head having a group of printing elements to which pixel data defining the image to be printed is passed sequentially on a group-by-group basis by the control means, the groups being sequentially printed adjacent one another in the direction of movement of the image receiving tape.

19. A tape printing apparatus as claimed in claim 18, wherein the sequential printing of the image on the image receiving tape is controlled by the control means in dependence on the speed of the image receiving tape.

20. A tape printing apparatus as claimed in claim 1, wherein the driven system comprises a dc motor.

21. A tape printing apparatus as claimed in claim 20, further comprising: speed control means to control the speed of rotation of the motor to be at an approximately constant level, the speed control means being coupled to the monitoring means, whereby the speed of the motor is controlled in dependence on the detected speed of the image receiving tape.

22. A tape printing apparatus as claimed in claim 21, wherein the speed control means controls the speed of rotation of the motor to maintain the approximately constant level by applying a maximum drive to the motor if the speed of the image receiving tape detected by said monitoring means falls below a first predetermined value, no drive if the speed of the image receiving tape exceeds a second predetermined value and a linear drive versus speed characteristic if the speed of the image receiving tape is between the first and second predetermined values.

23. A tape printing apparatus as claimed in claim 1, wherein the monitoring means is arranged to detect when a supply of image receiving tape is not present and to provide a signal indicative thereof.

24. A tape printing apparatus as claimed in claim 1, wherein the monitoring means is arranged upstream of the printing means.

25. A supply of image receiving tape arranged for use in a tape printing apparatus so that the image receiving tape can be driven past a printing location and an image printed thereon, the image receiving tape comprising a continuous printing layer having a top printing surface for receiving a printed image and a rear adhesive surface and a continuous backing layer removable to uncover the rear adhesive surface of the top printing layer, the image receiving tape carrying along its length regularly spaced detectable markings to provide an indication of the speed at which the image receiving tape is driven past the printing location, in combination with a tape printing apparatus the tape printing apparatus comprising:

input means for receiving data defining an image to be printed on the an image receiving tape;

receiving means for receiving a supply of the image receiving tape;

printing means for printing an image on the image receiving tape in accordance with the input data;

control means configured to control the printing means;

a drive system operable to drive the image receiving tape past the printing means; and monitoring means for monitoring the speed of the image receiving tape, the monitoring means being arranged to detect markings provided on the image receiving tape and to provide a signal indicative of the speed at which the image receiving tape moves past said printing means the signal being supplied to the control means for controlling the printing means in dependence on the speed of the tape indicated by the signal.

* * * * *